United States Patent [19]

Seddon

[11] Patent Number: 4,563,111

[45] Date of Patent: Jan. 7, 1986

[54] MINE ROOF SUPPORTS

[75] Inventor: James Seddon, Heskin, Near Chorley, England

[73] Assignee: Dobson Park Industries Plc., Nottingham, England

[21] Appl. No.: 585,927

[22] Filed: Mar. 5, 1984

[30] Foreign Application Priority Data

Mar. 8, 1983 [GB] United Kingdom ..... 8306354

[51] Int. Cl.[4] ..... E21D 15/44

[52] U.S. Cl. ..... 405/295; 405/291

[58] Field of Search ..... 405/291-296; 299/32

[56] References Cited

U.S. PATENT DOCUMENTS

| | | | |
|---|---|---|---|
| 4,026,118 | 5/1977 | McCay | 405/291 |
| 4,079,792 | 3/1978 | Paul et al. | 405/296 X |
| 4,132,081 | 1/1979 | Walker et al. | 405/296 |
| 4,139,326 | 2/1979 | Bower et al. | 405/292 |
| 4,231,684 | 11/1980 | Oppenlander et al. | 405/291 |

FOREIGN PATENT DOCUMENTS

| | | | |
|---|---|---|---|
| 1918048 | 10/1970 | Fed. Rep. of Germany | 405/294 |

*Primary Examiner*—Dennis L. Taylor

*Attorney, Agent, or Firm*—Murray, Whisenhunt and Ferguson

[57] ABSTRACT

A mine roof support has a roof engaging structure 13 and a floor engaging base 14, spaced apart by extensible hydraulic jack means 15 and 16. The roof engaging structure and the base are interconnected by a pivotal linkage device 23, 24 arranged so that, throughout its range of working movement, a pivot point of the linkage performs substantially greater movement in the vertical direction than in the horizontal direction. This reduces the effect of problems arising from the linkage device projecting substantially into the goaf area of a mine working or into the walkway area of the support. In a preferred embodiment the linkage device comprises a parallelogram type linkage.

18 Claims, 3 Drawing Figures

MINE ROOF SUPPORTS

BACKGROUND TO THE INVENTION

The invention relates to mine roof supports and particularly to hydraulic mine roof supports.

DESCRIPTION OF THE PRIOR ART

Hydraulic mine roof supports are well known for use in supporting the roof of a mine working adjacent to a mine face during the working of coal or other minerals using the long wall method.

Usually two roadways lead respectively to the two ends of the face, for the movement of men and material to and from the face. Between the face ends, immediately adjacent to the face, extends a conveyor. A coal cutting machine mounted on the conveyor moves back and forth along the face, cutting away a web of mineral with each pass. The cut mineral is deposited on to the conveyor and is conveyed to a face end for removal.

The mine roof supports are arranged in a line, side by side, adjacent to the conveyor but on the opposite side of the conveyor from the face. Each mine roof support conventionally has a floor engaging base and a roof engaging structure interconnected by hydraulic jacks. Ideally the jacks are spaced to provide a walkway, so that miners can walk along the side of the conveyor, passing between the jacks of each support and underneath the protective roof engaging structure.

Each time a web of mineral is cut away, the conveyor and the following line of hydraulic roof supports is advanced to a new position.

A generally accepted practice in the application of hydraulic mine roof supports is to present the mine engaging structure to the mine roof along the approximation of the roof lie, having due consideration for roof to floor convergence, which may be in the order of half an inch per foot in seams up to five foot high, and one inch per foot in seams over five foot high. In other words the roof engaging structure and floor engaging base are not quite parallel.

It will be apparent that the roof engaging structure must extend beyond the leading edge of the floor engaging base if it is to support the roof above the conveyor.

Because of the construction of the roof engaging structure, the greater the projection in front of the supporting jacks, the greater the out of balance effect and the greater the tendency for the leading part of the roof engaging structure to fall or drop on to the conveyor, and cause damage.

Fortunately, for most of the length of the face, the roof engaging structure need only project, cantilever fashion, for the width of the conveyor, and the out of balance effect can be accommodated by known constructions of roof support, for example as disclosed in U.K. Pat. No. 1494284.

However this forward projection may vary. For example at the face ends a greater reach over the base structure may be necessary, since at each face end there is usually a drive unit or gear head for the conveyor, mounted on the side of the conveyor remote from the face. Thus roof supports at this point must span not only the conveyor itself but also this drive unit or gear head.

The problem is aggrevated by the fact that it is difficult to position jacks close to the drive unit without hindering the free passage of men to and from the remainder of the face.

Previously the severe out of balance effect at the face ends has been compensated for by means of additional jacks acting opposed to the supporting jacks, thus maintaining equilibrium in the system, or by placing an additional jack at the leading edge of the roof engaging structure, i.e. between the conveyor and the face.

OBJECT OF THE INVENTION

It is an object of the present invention to provide a hydraulic mine roof support having a substantial forward projection of its roof engaging structure in line ahead of its floor engaging base, each support being stable in use and adapted to present its roof engaging structure to the roof generally along the total length of the roof engaging structure, during the operation of setting the support to the mine roof.

SUMMARY OF THE INVENTION

Accordingly the present invention provides a mine roof support having a roof engaging structure and a floor engaging base, spaced apart by extensible jack means, the roof engaging structure and the base being interconnected by a pivotal linkage device arranged so that, through its range of working movement, a pivot point of the linkage performs substantially greater movement in the vertical direction than in the horizontal direction.

Preferably the support has means for moving the support in a substantially horizontal direction perpendicular to the pivot axes of the pivotal linkage device.

The means for moving the support may comprise a ram arrangement acting in a direction perpendicular to the pivot axes of the pivotal linkage device.

The ram arrangement may comprise a hydraulic advancing jack connected to the base of the support and having means for connection to an abutment, for example the conveyor or its drive unit or gearhead.

The advancing jack may be positioned to be interadjacent floor engaging skids of the base.

Preferably the linkage device is a parallelogram type linkage ensuring that the roof engaging structure maintains a predetermined orientation with respect to the base, resisting any tendency for the leading edge of the roof engaging structure to tip downwardly.

Preferably the parallelogram type linkage comprises at least two parallel links of equal length.

Preferably the roof engaging structure and floor engaging base are rigid.

The roof engaging structure may have at least one downwardly extending projection, and the floor engaging base may have at least one upwardly extending projection, the said links being connected between the said projections.

Preferably the links are disposed to reduce to a minimum the arcuate movement effect experienced by the leading edge of the roof engaging structure and the said links are provided with close fitting pivot points with a view to ensuring that the leading edge of the roof engaging structure is maintained in its elevated position under the influence of the extensible jack means in cooperation with the links.

Preferably the extensible jack means is positioned towards the rear of the support.

The extensible jack means may comprise one, or a row of two or more jacks, the or each jack being pivotally mounted in the roof engaging structure and floor engaging base to allow for the arcuate movement effect produced by the parallelogram type linkage.

Other preferred features and advantages of the invention will become apparent from the following description of an embodiment of the invention, given by way of example.

DESCRIPTION OF AN EMBODIMENT OF THE INVENTION

Figure 1:
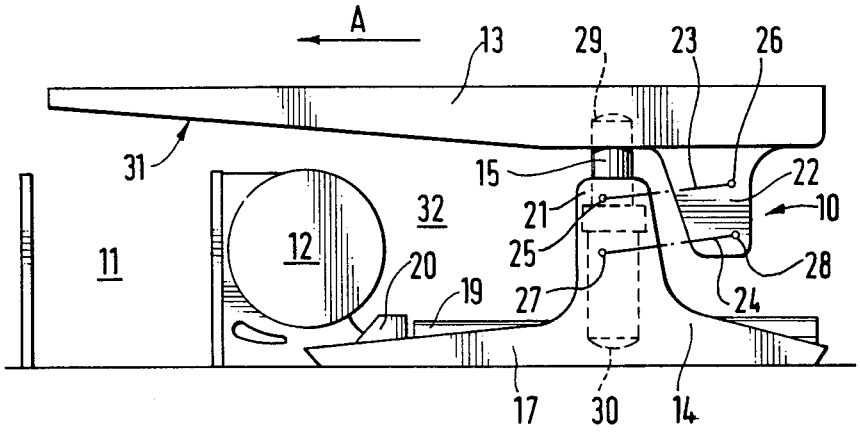
FIG. 1 is a side elevation of an embodiment of mine roof support according to the invention, in position adjacent to a mine face, and looking along the mine face.
Figure 2:
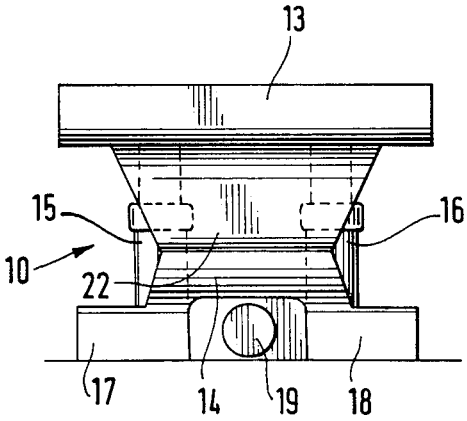
FIG. 2 is a rear elevation of this embodiment of the invention.
Figure 3:
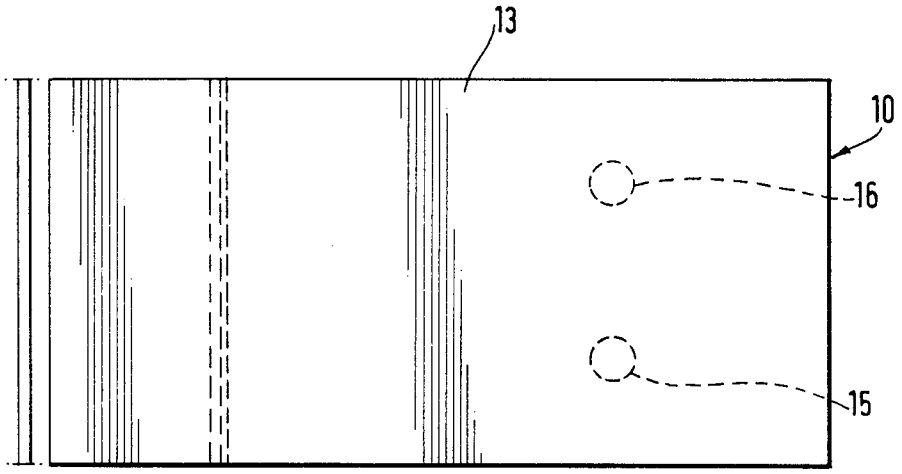
FIG. 3 is a plan view of this embodiment of the invention.

This particular embodiment of mine roof support according to the invention is illustrated generally in the Figures by the reference numeral 10 and as illustrated in FIG. 1 the mine roof support is positioned, in use, adjacent to a mine conveyor 11. The conveyor extends along the mine face of a long wall working. The mine face is not shown in FIG. 1 but lies immediately to the left of the conveyor 11.

The conveyor has, at the end of the face, a drive unit 12 attached thereto.

After each removal of a strip or web of mineral, for example coal, the conveyor 11 and roof support 10 are advanced in the direction of arrow A.

The mine roof support 10 has a rigid roof engaging structure 13 and a rigid base unit 14. A pair of spaced apart hydraulic jacks 15 and 16 extend between the base 14 and the roof engaging structure 13. The base unit 14 comprises a bridge member interconnecting to floor engaging skids 17 and 18. Underneath the bridging member and between the skids 17 and 18 passes an advancing jack 19 which is connected at one end to the base unit and is also connected to the conveyor drive head 12 at 20.

The base unit 14 also has an upwardly extending structure 21 and the roof engaging structure 13 has a downwardly extending structure 22. Connected between the upwardly extending structure 21 and the downwardly extending structure 22 are two parallel links 23 and 24 of equal length. The link 23 extends between a pivotal connection 25 and a pivotal connection 26. The link 24 extends between a pivotal connection 27 and a pivotal connection 28. The pivotal connections are manufactured to close tolerances, providing little or no "slop".

As can be seen from FIG. 1, the upper and lower ends of the jacks 15 and 16 are domed at 29 and 30 and these domed ends fit into sockets (not shown) in the roof engaging structure 13 and base 14, so that slight tilting movement of the jacks can be accommodated.

The roof engaging structure 13 may, for convenience, be tapered towards its forward end as shown at 31 to provide greater clearance over the conveyor 11.

To improve access to the mine workings a walkway or travelling track is provided in the space 32.

In use a web or strip of mineral is removed in front of the conveyor 11 whilst the hydraulic roof support remains firmly fixed in position between the floor and roof of the mine working by extension of the jacks 15 and 16. Once the web or strip has been removed, the conveyor 11, together with its drive unit 12, is advanced towards the newly exposed face by extension of the jack 19 on the support illustrated and the adjacent supports with which it will be used. During this stage of operations each mine roof support remains in its roof supporting condition in which it is firmly wedged between floor and roof. The next stage is to release the pressure fluid in the jacks 15 and 16, which disengages the structure 13 from the roof. Because of the parallelogram type linkage which is provided by the links 23 and 24, the lowering of the roof engaging structure will be parallel to its supporting plane. Once the roof supporting structure has been lowered from the roof the jack 16 is retracted to advance the roof support into the space previously occupied by the conveyor and conveyor drive unit. Upon reaching its new position the roof engaging structure is reset to the mine roof by re-extension of the jacks 15 and 16. The roof supports are advanced one at a time in a conventional manner.

The space between the skids 17 and 18 is so designed to allow loose material on the floor to be "flushed" or left behind as the support is advanced.

It will be seen that the roof engaging structure 13 has to span a considerable distance, cantilever fashion, between its leading support, namely the jacks 15 and 16, and its leading edge. This is because the roof engaging structure has to pass over the walkway in the space 32, the drive unit 12, and the conveyor 11. However the parallelogram type linkage which is provided by the links 23 and 24 ensure that as the roof engaging structure 13 moves upwardly or downwardly, it must move in a parallel fashion. In other words the orientation of the upper surface of the roof engaging structure remains constant. Any tendency for the leading edge of the roof engaging structure to dip downwardly is counteracted by the action of the parallelogram type linkage.

To give the parallelogram type linkage as close control as possible over the movement of the roof engaging structure 13, the pivot points 26 are made a close fit as mentioned above.

A parallelogram type linkage of course involves an arcuate movement of the links and this arcuate movement is transmitted, to a limited extent, to the roof engaging structure 13. In order to reduce as much as possible the effect of this arcuate movement, in terms of causing the roof engaging structure 13 to move to the left or the right relative to the base 14, the links 23 and 24 are positioned almost horizontally, by arranging for them to extend between the upwardly extending structure 21 and the downwardly extending structure 22.

In conventional supports it is usual to have retaining means for determining the attitude of the jacks 15 and 16, such as rubber bushes or other hydraulic jacks. However this embodiment requires no such alignment means since control is excerised by the parallelogram type linkage.

The invention is not restricted to the details of the foregoing embodiment.

I claim:

1. A mine roof support comprising:

(a) a floor engaging base having a front end and a rear end, the base being in the form of a pair of elongate, spaced-apart skids;

(b) at least one first projection extending upwardly from the base, positioned towards the rear end of the base;

(c) a substantially rigid roof engaging structure having a front end and a rear end;

(d) at least one second projection extending downwardly from the roof engaging structure, positioned towards the rear end of the structure;

(e) at least one pair of parallel links of equal length, each link of the pair extending from a first pivotal axis on the said first projection to a second pivotal axis of the said second projection, the said axes extending transversely of the base, the links thus controlling the orientation of the roof engaging structure with respect to the base;

(f) extensible hydraulic jack means acting between the floor engaging base and the roof engaging structure and operable to move the roof engaging structure with respect to the floor engaging base over a range of movement which causes the parallel links to move through a horizontal position;

(g) a hydraulic advancing jack positioned substantially horizontally between the skids of the base, the jack extending parallel to the skids and perpendicular to the pivotal axes of the said links;

(h) means attaching one part of the advancing jack to the base; and (i) means for attaching another part of the advancing jack to an abutment so that the advancing jack can act between the base and the abutment to move the mine roof support forwardly in a substantially horizontal direction perpendicular to the pivotal axes of the said links.

2. A mine roof support comprising:

(a) a rigid floor engaging base unit having at least one upwardly extending projection rigid therewith;

(b) a rigid roof engaging structure having at least one downwardly extending projection rigid therewith;

(c) extensible hydraulic jack means extending between the base unit and the roof engaging structure;

(d) and a pivotal linkage interconnecting the said upwardly extending projection and the said downwardly extending projection;

the linkage having a range of working movement during which a pivot point of the linkage performs the maximum arcuate movement in the vertical direction for the minimum arcuate movement in the horizontal direction; and the linkage being a parallelogram type linkage thus ensuring that the roof engaging structure maintains a predetermined orientation with respect to the base unit, resisting any tendency for the leading edge of the roof engaging structure to tip downwardly.

3. A mine roof support as claimed in claim 2, in which the support has means for moving the support in a substantially horizontal direction perpendicular to the pivot axes of the pivotal linkage device.

4. A mine roof support as claimed in claim 3, in which the means for moving the support comprises a ram arrangement acting in a direction perpendicular to the pivot axes of the pivotal linkage device.

5. A mine roof support as claimed in claim 4, in which the ram arrangement comprises a hydraulic advancing jack connected to the base of the support and having means for connection to an abutment.

6. A mine roof support as claimed in claim 5, in which the advancing jack is positioned to be inter-adjacent floor engaging skids of the base.

7. A mine roof support as claimed in claim 2, in which the parallelogram type linkage comprises at least two parallel links of equal length.

8. A mine roof support as claimed in claim 2, in which the linkage comprises elongate links which, during their range of working movement, pass through a horizontal position.

9. A mine roof support as claimed in claim 2, in which the linkage device is disposed to reduce to a minimum the arcuate movement effect experienced by the leading edge of the roof engaging structure.

10. A mine roof support as claimed in claim 2, in which the links of the linkage device are provided with close fitting pivot points with a view to ensuring that the leading edge of the roof engaging structure is maintained in its elevated position under the influence of the extensible jack means in co-operation with the links.

11. A mine roof support as claimed in claim 2, in which the extensible hydraulic jack means extend substantially vertically.

12. A mine roof support as claimed in claim 2, in which the extensible jack means is positioned towards the rear of the support.

13. A mine roof support as claimed in claim 2, in which the extensible jack means comprise one, or a row of two or more, jacks, the or each jack being pivotally mounted in the roof engaging structure and floor engaging base to allow for the effect of arcuate movement produced by the parallelogram type linkage.

14. A mine roof support comprising:

(a) a rigid floor engaging base unit having at least one upwardly extending projection rigid therewith;

(b) a rigid roof engaging structure having at least one downwardly extending projection rigid therewith;

(c) extensible hydraulic jack means extending between the base unit and the roof engaging structure;

(d) and linkage means associated with pivot points for maintaining a predetermined orientation of the roof engaging structure with respect to the base unit and for resisting any tendency for the leading edge of the roof engaging structure to tip downwardly and for having a pivot point of the linkage means perform the maximum arcuate movement in the vertical direction for the minimum arcuate movement in the horizontal direction, said linkage means including a parallelogram type linkage pivotally interconnecting the upwardly extending projection and the downwardly extending projection.

15. A mine roof support as claimed in claim 14, wherein the pivot points of said linkage means on the downwardly extending projection perform substantially greater movement in the vertical direction then in the horizontal direction upon operation of said hydraulic jack.

16. Mine roof support as claimed in claim 14, wherein said parallelogram type linkage includes at least two parallel links of equal length.

17. A mine roof support as claimed in claim 14, wherein the hydraulic jack means is pivotally mounted in the said base unit and the roof engaging structure to allow for the arcuate movement effect produced by the parallelogram type linkage.

18. Mine roof support as claimed in claim 14, wherein the roof engaging structure assumes a supporting plane when engaged with a mine roof, and is maintained parallel to said supporting plane upon lowering of said roof engaging structure.

* * * * *